United States Patent [19]

Sato

[11] Patent Number: 4,863,400

[45] Date of Patent: Sep. 5, 1989

[54] ELECTRICAL CONNECTOR

[75] Inventor: Kensaku Sato, Tokyo, Japan

[73] Assignee: Hirose Electric Co., Ltd., Tokyo, Japan

[21] Appl. No.: 316,563

[22] Filed: Feb. 27, 1989

Related U.S. Application Data

[63] Continuation of Ser. No. 126,892, Nov. 30, 1987, abandoned.

[30] Foreign Application Priority Data

Jan. 12, 1986 [JP] Japan ..... 61-284136

[51] Int. Cl.[4] ..... H01R 13/40

[52] U.S. Cl. ..... 439/595; 439/400; 439/603

[58] Field of Search ..... 439/80, 398, 399, 400, 439/404, 406, 418, 426, 436, 442, 595, 598, 603

[56] References Cited

U.S. PATENT DOCUMENTS

| | | | |
|---|---|---|---|
| 3,634,811 | 1/1972 | Teagno et al. | 439/595 |
| 3,697,925 | 10/1972 | Henschen | 439/603 |
| 3,711,819 | 1/1973 | Matthews | 439/80 |
| 3,990,759 | 11/1976 | Crowe | 439/595 |
| 4,385,794 | 5/1983 | Lucius | 439/399 |
| 4,571,017 | 2/1986 | Fujita | 439/595 |
| 4,602,836 | 7/1986 | Garretson et al. | 439/595 |
| 4,714,306 | 12/1987 | Miyazawa et al. | 439/400 |

FOREIGN PATENT DOCUMENTS

| | | | |
|---|---|---|---|
| 60-130582 | 9/1985 | Japan . | |
| 2137027 | 9/1984 | United Kingdom | 439/595 |

*Primary Examiner*—P. Austin Bradley
*Attorney, Agent, or Firm*—Takeuchi Patent Office

[57] ABSTRACT

An electrical connector comprises a plurality of piercing type contacts, a plurality of crimping type contacts, and an insulating housing with a plurality of receiving apertures each capable of receiving a contacting section of either piercing or crimping type contact.

4 Claims, 2 Drawing Sheets

ELECTRICAL CONNECTOR

This is a continuation of application Ser. No. 126,892 filed Nov. 30, 1987, now abandoned.

BACKGROUND OF THE INVENTION

The present invention relates generally to electrical connectors and, more particularly, to an electrical connector having both piercing and crimping type contacts.

Japanese U.M. Patent Kokai No. 60-130582 discloses an electrical connector having both piercing and crimping type contacts. The insulating housing of the electrical connector has receiving apertures for receiving respective piercing and crimping contacts. The crimping contacts are used for power supplies of larger current capacity and the piercing contacts are used for signals of smaller current capacity.

However, the above receiving apertures are different in structure between the crimping and piercing contacts so that it has been impossible to replace a crimping contact with a piercing contact or vice versa. As a result, it has been impossible to change the number of crimping contacts for power supplies or piercing contacts for signals.

SUMMARY OF THE INVENTION

Accordingly, it is an object of the invention to provide an electrical connector in which both piercing and crimping contacts may be arranged in a given pattern.

According to the invention there is provided an electrical connector having a plurality of piercing type contacts, a plurality of crimping type contacts, and an insulating housing with a plurality of receiving apertures capable of receiving contacting sections of both the piercing and the crimping type contacts, characterized in that the contacting sections of both the piercing and the crimping type contacts are identical in structure and each have latch means for engagement with the receiving aperture when each contact is inserted into a predetermined point; the receiving apertures each have a channel for receiving a rod portion of a contact removing tool; the latch means is brought into a release position by insertion of the rod portion of the contact removing tool; the piercing type contacts each have a piercing member with a piercing slit; and the crimping type contacts each have a pair of crimp tabs to be crimped to secure exposed wires of a conductor.

Since the contacting sections of both piercing and crimping type contacts to which respective conductors have been connected are identical and are capable of engaging any of the receiving apertures of an insulating housing, both the piercing and the crimping type contacts may be assembled in the insulating housing according to user's design.

By inserting a contact removing tool into a channel to release the engagement between the contact and the receiving aperture, the wrong contact may be easily replaced with a right one.

Other objects, features, and advantages of the invention will be apparent from the following description when taken in conjunction with the accompanying drawings.

DESCRIPTION OF THE PREFERRED EMBODIMENTS

Figure 1:
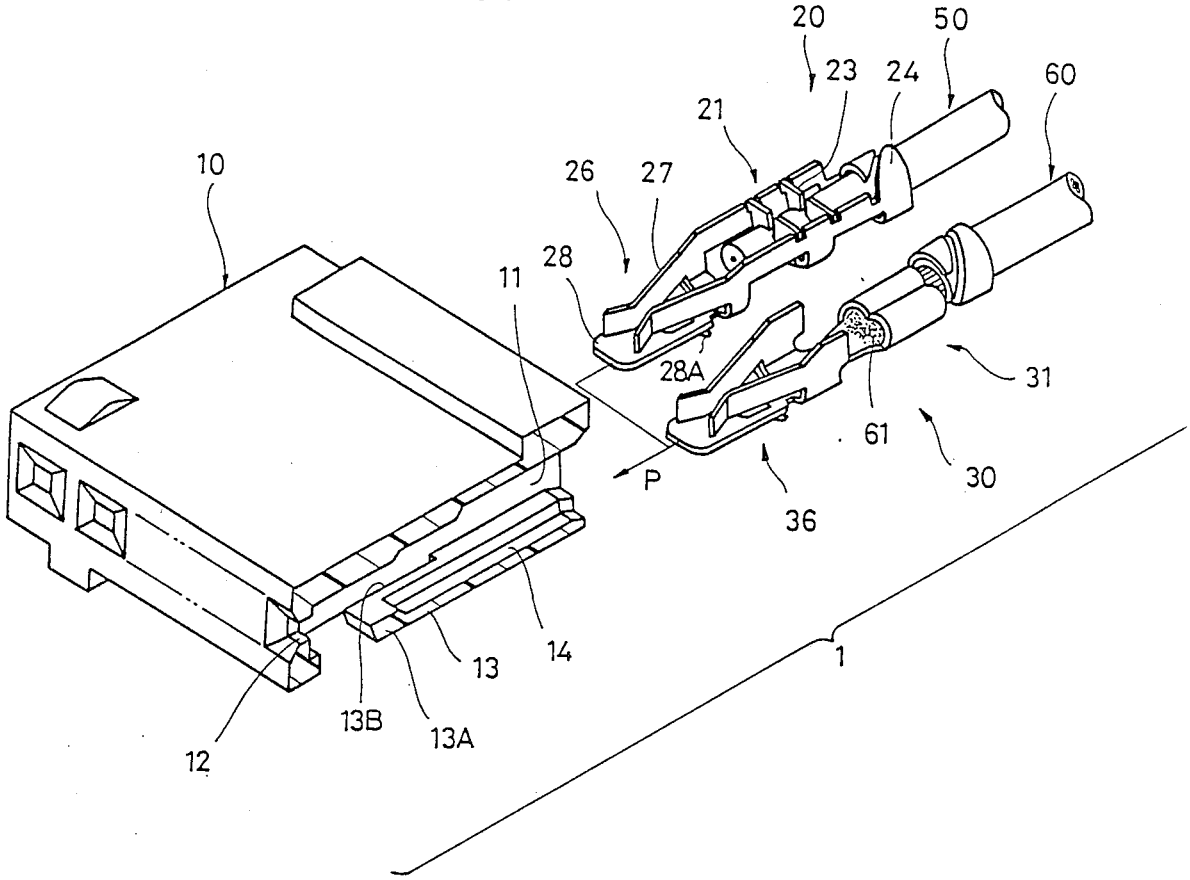
FIG. 1 is an exploded perspective view of an electrical connector embodying the present invention.

In FIG. 1, an electrical connector 1 consists of an insulating housing 10 made of a plastic or other insulating material, and piercing type contacts 20 and crimping type contacts 30, both types being made by stamping and bending a resilient, conductive metal sheet.

The insulating housing 10 has receiving apertures 11 aligned in equal intervals for receiving the piercing or crimping type contacts 20 or 30. Each receiving aperture 11 has at the front end a tapered mouth 12 for receiving a male contact of a mating connector. It also has in the middle bottom a resilient latch arm 13 for engagement with a latch tongue 28A of the contact 20 or 30. The latch arm 13 is defined by a U-shaped cut 13B extending from the middle toward the front end. It has at the front end a latch protuberance 13A with a tapered rear wall. The latch arm 13 and latch tongue 28A constitute a latch device. On the bottom of the receiving aperture 11 there is also formed a channel 14 extending from the rear end in the insertion direction P of an contact for receiving the rod portion of a contact removing tool 40, which will be described hereinafter.

Figure 2:
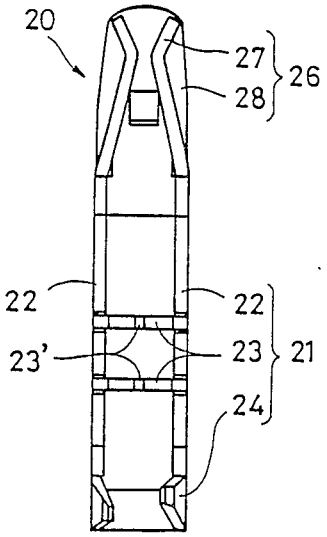
FIGS. 2, 3, and 4 are top, side, and bottom views of the piercing type contact of FIG. 1.
Figure 3:
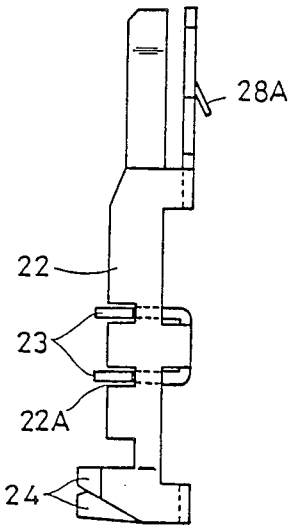
Figure 4:
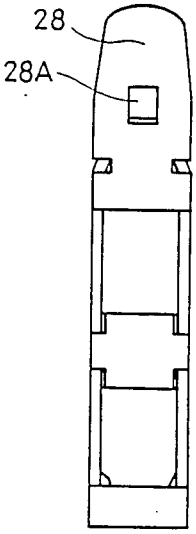

In FIGS. 2, 3, and 4, the female contact 20 of the piercing type consists of a connecting section 21 for connection by piercing and a contacting section 26 for contact with the male contact of a mating connector. The connecting section 21 has a pair of side walls 22 between which a U-shaped cross-section piercing member with a pair of piercing walls 23 is provided. Each piercing wall 23 has in the middle a piercing slit 23' for connection by piercing with a conductor 50 (FIG. 1). The upper sides of each piercing wall 23 are fitted into cuts **22*a* on the side walls 22 to prevent the piercing wall from falling down. Behind the connecting section 21 there are provided a pair of clamp tabs 24 to be crimped to secure the conductor 50 to the contact 20. The contacting section 26 has a pair of contact pieces 27 extending from the side walls and bent in a V-shape to form a throat portion 27A between them and a base plate 28 lying a plane perpendicular to the contact pieces and having in the center a latch tongue 28A** punched out downwardly.

Figure 5:
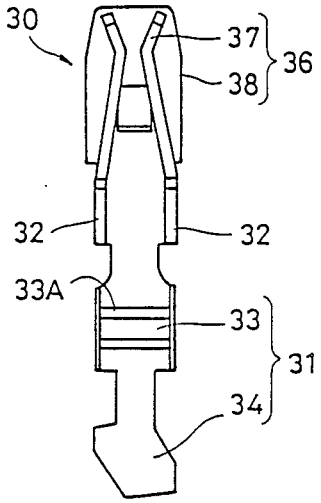
FIGS. 5 and 6 are top and side views of the crimping type contact of FIG. 1.
Figure 6:
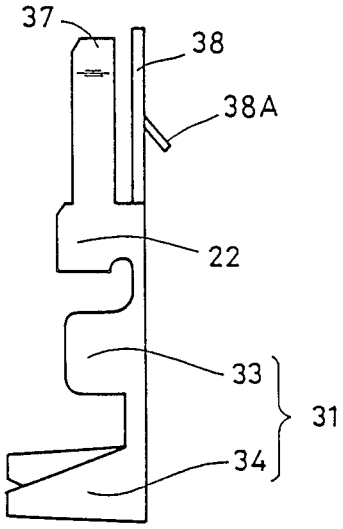

In FIGS. 5 and 6, the crimping type contact 30 consists of a connecting section 31 and a contacting section 36. The contacting section 36 is substantially identical with the above contacting section 20. The connecting section 31 consists of a U-shaped cross-section crimping member with a pair of crimp tabs 33 and a strain relief portion with a pair of clamp tabs 34. The tabs 33 and 34 are crimped to secure the exposed wires 61 and the sheathed conductor 60, respectively, to the contact 30 (FIG. 1). A pair of rims 33A are provided on the bottom of the crimping section 33 for firmer grip of the exposed wires 61.

A method of assembling the electrical connector 1 will now be described.

(1) Conductors 50 of smaller current capacity are connected by piercing to piercing type contacts 20 by means of a piercing tool or machine (not shown). Conductors 60 of larger current capacity are connected by crimping to crimping type contacts 30 by means of a crimping tool or machine (not shown). In FIG. 1, only one of each type is shown.

(2) The piercing and crimping type contacts 20 and 30 are arranged in a sequential or spatial relationship with each other according to user's design and inserted into the receiving apertures 11 in sequence or all at once.

(3) When the contact 20 or 30 reaches a certain point, the latch tongue 28A or 38A engages the the latch protuberance 13A to secure the contact within the receiving aperture 11, thus completing an electrical connector 1 . The front end 13A' of the latch arm 13A is inclined so that when a pulling force F is applied to the contact 20, the latch tongue 28A does not disengage from the latch arm 13A.

Figure 7:
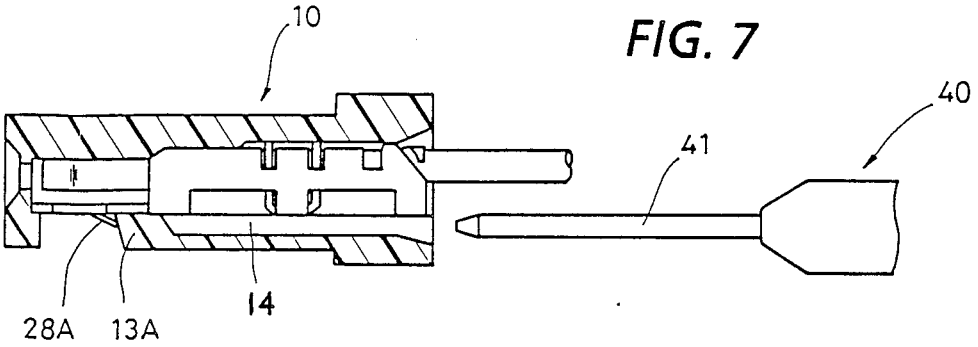
FIGS. 7 and 8 are sectional views of the conductor before and after a tool is inserted into the housing, respectively, to remove a contact.
Figure 8:
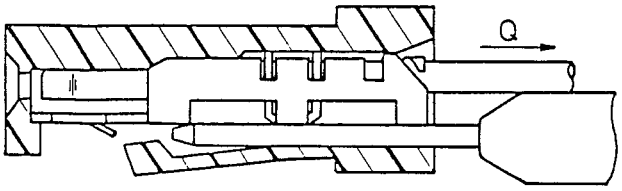

In FIGS. 7 and 8, when a piercing contact 20 instead of a crimping contact 30, or vice versa, has been inserted into a receiving aperture by mistake, or one of the piercing or crimping contacts 20 or 30 becomes defective, the rod portion 41 of a contact removing tool 40 is inserted into the receiving aperture 11 along the channel 14, FIG. 7, to push down the latch protuberance 13A so that the cantilever latch arm 13 resiliently bend to release the latch tongue 28A, as shown in FIG. 8. Under these conditions, it is possible to pull out the contact 20 or 30 from the receiving aperture 11 in the direction of an arrow Q. Thus, a wrong or defective contact may be easily replaced with a right or good one.

Since all the receiving apertures in the housing are identical and all the contacting sections of piercing and crimping contacts are identical, a user may connect conductors of different current capcities to diffeent types of contacts and assemble them in the housing according to user's design.

The individual contacts assembled in the housing may be easily removed by means of a simple tool so that when the design is changed, it is possible to replace only the affected contacts with new ones without discarding the whole connector, thus making the maintenance easier and the repair cost lower.

While a preferred embodiment of the invention has been described using specific terms, it is to be understood that changes and variations may be made without departing from the spirit and scope of the invention recited in the appended claims.

I claim:

1. An electrical connector comprising:

a plurality of piercing type contacts, each having a contacting section and a piercing member with a piercing slit into which a first conductor is pushed;

a plurality of crimping type contacts, each having a contacting section and a pair of clamp tabs to be crimped to secure an exposed wire section of a second conductor;

said contacting sections of both said piercing type contacts and said crimping type contacts being made identical in structure;

an insulating housing with a plurality of receiving apertures at least two of which are made identical in structure so as to be able to receive said contacting section of each of both said piercing type contacts and said crimping type contacts;

said identical receiving apertures each including a resilient latch arm defined by a U-shaped cut on a bottom wall thereof so that it extends forward and first latch means provided on a free end of said latch arm;

each said contacting section including a base plate which is sufficiently flat to slide along said bottom wall thereby permitting smooth insertion thereof, a pair of contact pieces extending in places perpendicular to said base plate and bent so as to provide a throat portion, and second latch means provided on a back of said base plate for engagement with said first latch means of said latch arm; and a channel provided on said latch arm extending forward from a rear portion of said latch arm for receiving a rod portion of a contact removing tool to flex downwardly said latch arm, thus releasing said first latch means from said second latch means.

2. The electrical connector of claim 1, wherein said piercing and crimping type contacts each have a pair of strain relief tabs to be crimped to an insulation of each of said first and second conductors.

3. The electrical connector of claim 1, wherein said first latch means is made in the form of a protuberance; and said second latch means is made in the form of a tongue punched out downwardly from said base plate.

4. The electrical connector of claim 3, wherein said protuberance has an inclined front end so that when a pulling force is applied to said contact, said latch tongue does not disengage from said latch protuberance.

* * * * *